US006212703B1

(12) United States Patent
Shimizu

(10) Patent No.: US 6,212,703 B1
(45) Date of Patent: Apr. 10, 2001

(54) HAIR WASHING APPARATUS AND A NECK RECEIVING MEMBER USED THEREFOR

(75) Inventor: Hirohisa Shimizu, Osaka (JP)

(73) Assignee: Oohiro Works, Ltd., Osaka (JP)

( * ) Notice: Subject to any disclaimer, the term of this patent is extended or adjusted under 35 U.S.C. 154(b) by 0 days.

(21) Appl. No.: 09/378,186

(22) Filed: Aug. 20, 1999

(30) Foreign Application Priority Data

Nov. 27, 1998 (JP) ..... 10-336423

(51) Int. Cl.[7] ..... A45D 19/00
(52) U.S. Cl. ..... 4/515; 4/519
(58) Field of Search ..... 4/516, 515, 517, 4/518, 519, 598, 602, 601, 618, 603, 597, 605

(56) References Cited

U.S. PATENT DOCUMENTS 4,901,378 * 2/1990 Reddell ..... 4/515
5,906,012 * 5/1999 Sakane et al. ..... 4/519

FOREIGN PATENT DOCUMENTS 10-211012 8/1998 (JP) .
350246 1/1999 (TW) .

* cited by examiner

*Primary Examiner*—Gregory L. Huson
*Assistant Examiner*—Khoa Huynh
(74) *Attorney, Agent, or Firm*—Burr & Brown

(57) ABSTRACT

A hair washing apparatus including a cistern having an opening on an upper part thereof, into which a person under hair washing inserts his head while lying on his back and a neck receiving part for receiving a neck of the person, the neck receiving part provided at an entering edge part of the cistern, wherein the neck receiving part comprises a board having a plurality of slits or small holes. The cistern includes a wash water spouting means for spouting wash water toward an underside part of the neck receiving part, and the wash water spouting means includes a rotatable water supply pipe having a plurality of spouts and a lever provided on the water supply pipe. The lever allows for rotation of the water supply pipe about the longitudinal axis thereof to adjust a spouting angle of the wash water.

3 Claims, 8 Drawing Sheets

Fig.8 - Prior Art
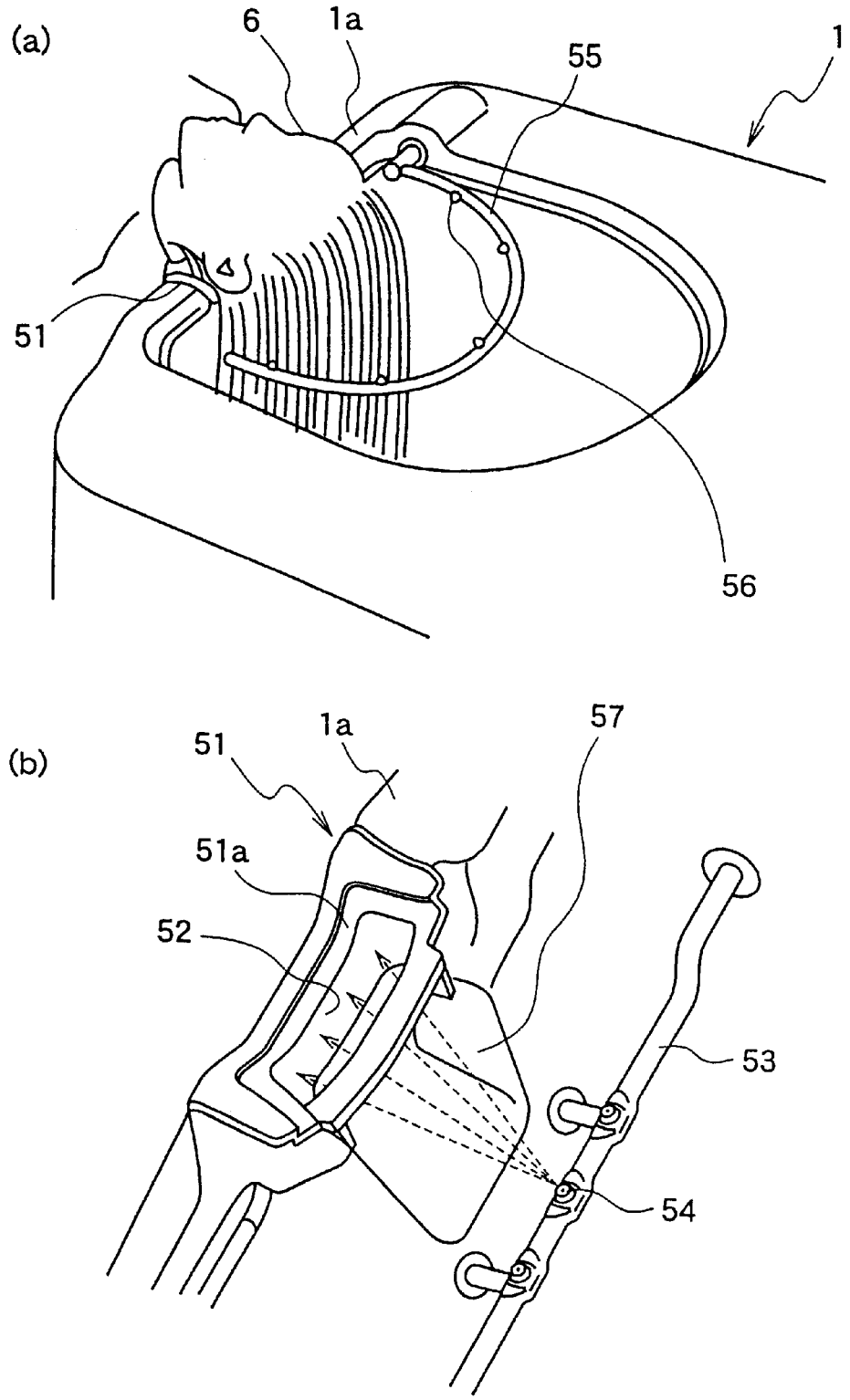

HAIR WASHING APPARATUS AND A NECK RECEIVING MEMBER USED THEREFOR

FIELD OF THE INVENTION

The present invention relates to a hair washing apparatus used in a beauty salon, a barber's shop or the like and a neck receiving member used therefor, and more particularly, to a hair washing apparatus for washing hair at a neck part of a person.

BACKGROUND OF THE INVENTION

FIG. 8 is a drawing illustrating a construction of a prior art hair washer for washing hair at a neck part of a person. FIG. 8(*a*) is a perspective view schematically illustrating the construction of the hair washer and FIG. 8(*b*) is a perspective view illustrating the construction of a hair washer for washing hair at the neck part of the person.

In FIG. 8(*a*), the hair washer has a cistern 1 having an opening on its upper part. A neck receiving member 51 for receiving neck of a person 6 whose hair is washed while lying on his back, is disposed at an entering edge part la of the cistern 1. Reference numeral 55 designates a head part washing pipe for washing hair at the head part of the person 6. Numeral 56 designates a nozzle spouting wash water.

Next, in FIG. 8(*b*), a groove 57 is provided at the entering edge part 1*a* of the cistern 1 and the neck receiving member 51 is disposed at an upper end of the groove 57. The neck receiving member 51 is disposed such that a neck receiving part 51*a* receiving the neck part of the person 6 covers the groove 57. The neck receiving part 51*a* has a wash water through hole 52 for passing wash water. A neck part washing pipe 53 for spouting the wash water from a nozzle 54 thereof toward the wash water through hole 52 of the neck receiving member 51 is disposed at a lower part of the cistern 1.

A hair washing operation at a neck part by the prior art hair washer described above will now be discussed.

First, the person 6 lies on his back and inserts his head into the opening of the cistern 1 such that the neck part is received by the neck receiving part 51*a* of the neck receiving member 51.

Then, the hair washer is operated to wash hair at the neck part. The wash water is spouted from the nozzle 54 of the neck part washing pipe 53 toward the wash water through hole 52 of the neck receiving member 51, thereby washing hair at the neck part of the person 6.

However, in the above prior art hair washer, the neck part of the person 6 is received by the neck receiving part 51*a* of the neck receiving member 51, which has one large wash water through hole 52. While using the prior art hair washer, the person 6 feels something is wrong at the neck part.

SUMMARY OF THE INVENTION

To solve the above problems, it is an object of the present invention to provide a hair washer which can make the person under hair washing feel less as if something is wrong at the neck part when washing hair at the neck part using the neck receiving member therefor.

According to a first aspect of the present invention, a hair washing apparatus comprises a cistern having an opening on an upper part thereof, into which a person under hair washing inserts his head, lying on his back, and a neck receiving part for receiving a neck part of the person, which is provided at an entering edge part of the cistern, wherein the neck receiving part comprising a board having plural slits or small holes, and the cistern has a wash water spouting means for spouting wash water toward an underside of a part of the neck receiving part, which has the plural slits or small holes. Therefore, in washing hair at the neck part, the neck part of the person can be received by the part of the neck receiving part, which has the slits or small holes, whereby the person feels less something is wrong at the neck part with relative to the prior art.

According to a second aspect of the present invention, the hair washing apparatus includes a notch formed at the entering edge part of the cistern, and a neck receiving member comprising a board which is bent in the form of an approximately inverted J and has a neck receiving part formed on a part except for left and right edge parts on its upper surface part, the neck receiving member being arranged at the notch such that a peripheral part except for a lower edge part of its rear surface overlaps with a peripheral part of the notch at the entering edge part of the cistern. Therefore, it is possible to provide a hair washing apparatus which reduces the feeling that something is wrong at the neck part and has a neck receiving part formed independently.

According to a third aspect of the present invention, the hair washing apparatus includes wash water spouting means arranged on a part of the notch, which is covered by the neck receiving member. Therefore, it is possible to spout wash water sufficiently, thereby enhancing the detergency.

According to a fourth aspect of the present invention, the hair washing apparatus includes wash water spouting means which can adjust a spouting angle of the wash water. Therefore, it is possible to wash hair at the neck part in the most suitable condition according to figures, hairstyles, or dirt levels of the hair of the person.

According to a fifth aspect of the present invention, the hair washing apparatus of includes a notch which is formed at the entering edge part of the cistern, and a neck receiving member comprising a box body having sides and a bottom which are engaged with sides and a bottom of the notch, an opening at a lower part of its rear surface, and a neck receiving part formed on its upper wall part, the neck receiving member being engaged with the notch and attached to the entering edge part of the cistern. Therefore, it is possible to provide the hair washer which enables reduction of the feeling that something is wrong at the neck part and, also, allows one to attach or detach the neck receiving member easily.

According to a sixth aspect of the present invention, the hair washing apparatus includes wash water spouting means arranged inside of the neck receiving member. Therefore, it is possible to spout wash water sufficiently, thereby enhancing the detergency.

According to a seventh aspect of the present invention, a hair washing apparatus includes a neck receiving member attached to a notch which is formed at an entering edge of a cistern of the hair washer so as to be engaged with the notch, the neck receiving member comprising a box body having sides and a bottom which are engaged with sides and a bottom of the notch, an opening at a lower part of its rear surface, and a neck receiving part for receiving a neck part of a person under hair washing, lying on his back, which comprises a board having plural slits or small holes, on its upper wall part. Therefore, it is possible to provide a neck receiving member which can be attached or detached to the cistern easily.

BRIEF DESCRIPTION OF THE DRAWINGS

FIG. 5(*b*) is a view illustrating the connection construction seen from a direction shown by an arrow A in FIG. 5(*a*);

FIG. 8(*a*) is a perspective view schematically illustrating a construction of a prior art hair washer; and FIG. 8(*b*) is a perspective view illustrating a construction of the prior art hair washer, for washing hair at a neck part of a person;

DETAILED DESCRIPTION OF THE PREFERRED EMBODIMENTS

Figure 1:
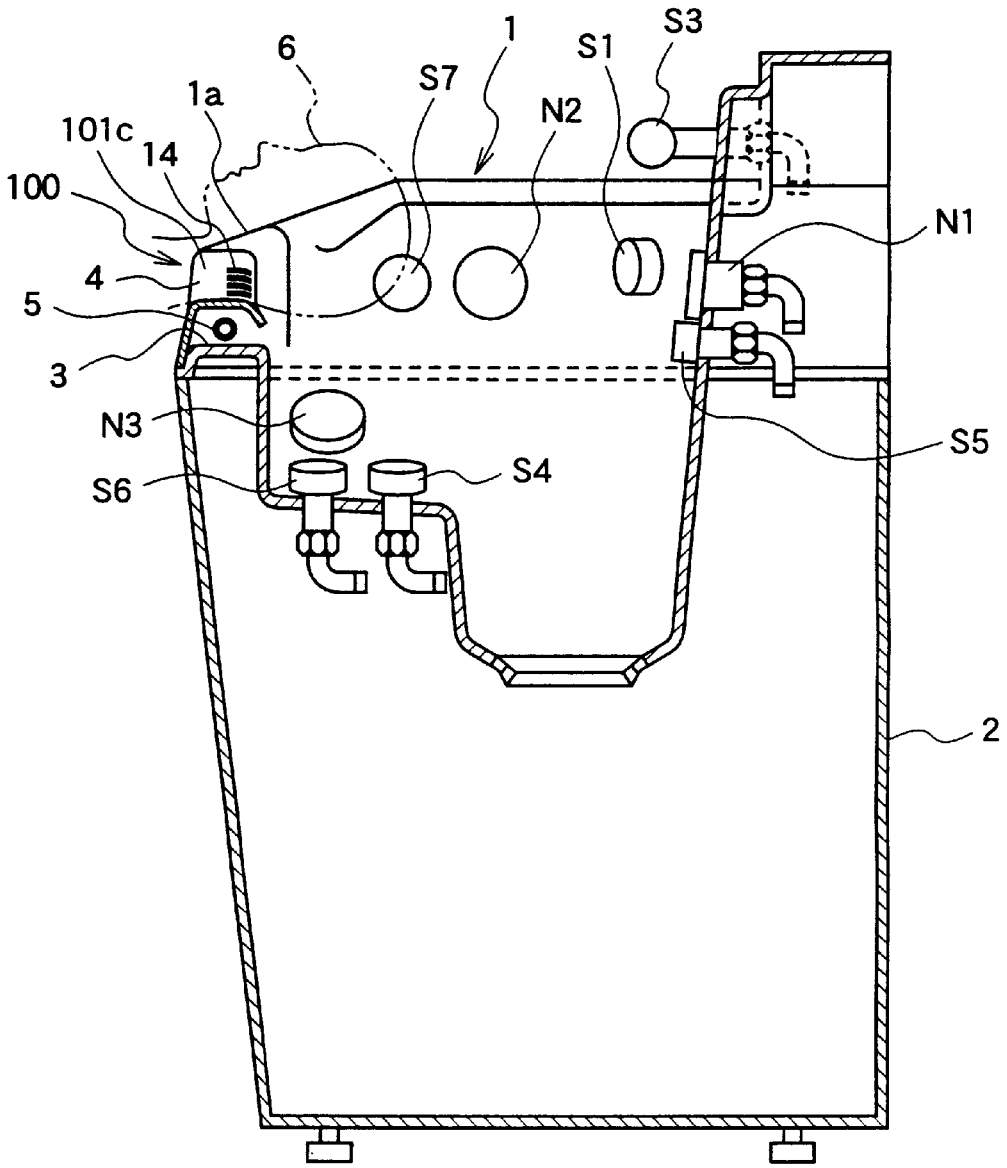
FIG. 1 is a longitudinal sectional view schematically illustrating a construction of a hair washer according to a first embodiment of the present invention.

FIG. 1 is a longitudinal sectional view schematically illustrating a construction of a hair washer according to a first embodiment of the present invention.

In the figure, a hair washer according to the first embodiment has a cistern 1. The cistern 1 has a thick peripheral part formed by bending its sidewall, and the peripheral part is held by a cabinet 2. The cistern 1 has an opening at an upper part thereof, into which a person 6 under hair washing inserts his head, while lying on his back. The cistern has a neck receiving part 101*c* which receives a neck part of the person 6, at an entering edge part 1*a* thereof. This neck receiving part 101*c* is formed on a neck receiving member 4 arranged at a notch 3 which is formed at the entering edge part 1*a* of the cistern 1. A washing pipe 5 for spouting wash water toward an underside of a part having slits 14 of the neck receiving part 101*c* on the neck receiving member 4 is arranged at a part of the notch 3, which is covered by the neck receiving member 4. Here, the wash water and the wash water mixed with shampoo agent or rinse agent is switched and supplied to the washing pipe 5.

In addition, shower heads S1 to S7 for spouting the wash water to the head and neck part of the person 6, and nozzle heads N1 to N3 for spouting the wash water mixed with the shampoo agent or the rinse agent to the head and neck part of the person 6 are arranged on inner surfaces of the cistern 1. These shower heads S1 to S7, nozzle heads N1 to N3, and the washing pipe 5 are constituted so as to automatically spout the wash water in accordance with the control of a control device (not shown).

Next, a detailed construction of a part 100 having a neck receiving part 101*c* at the entering edge part of the cistern will be described with reference to FIGS. 2 and 3.

Figure 2:
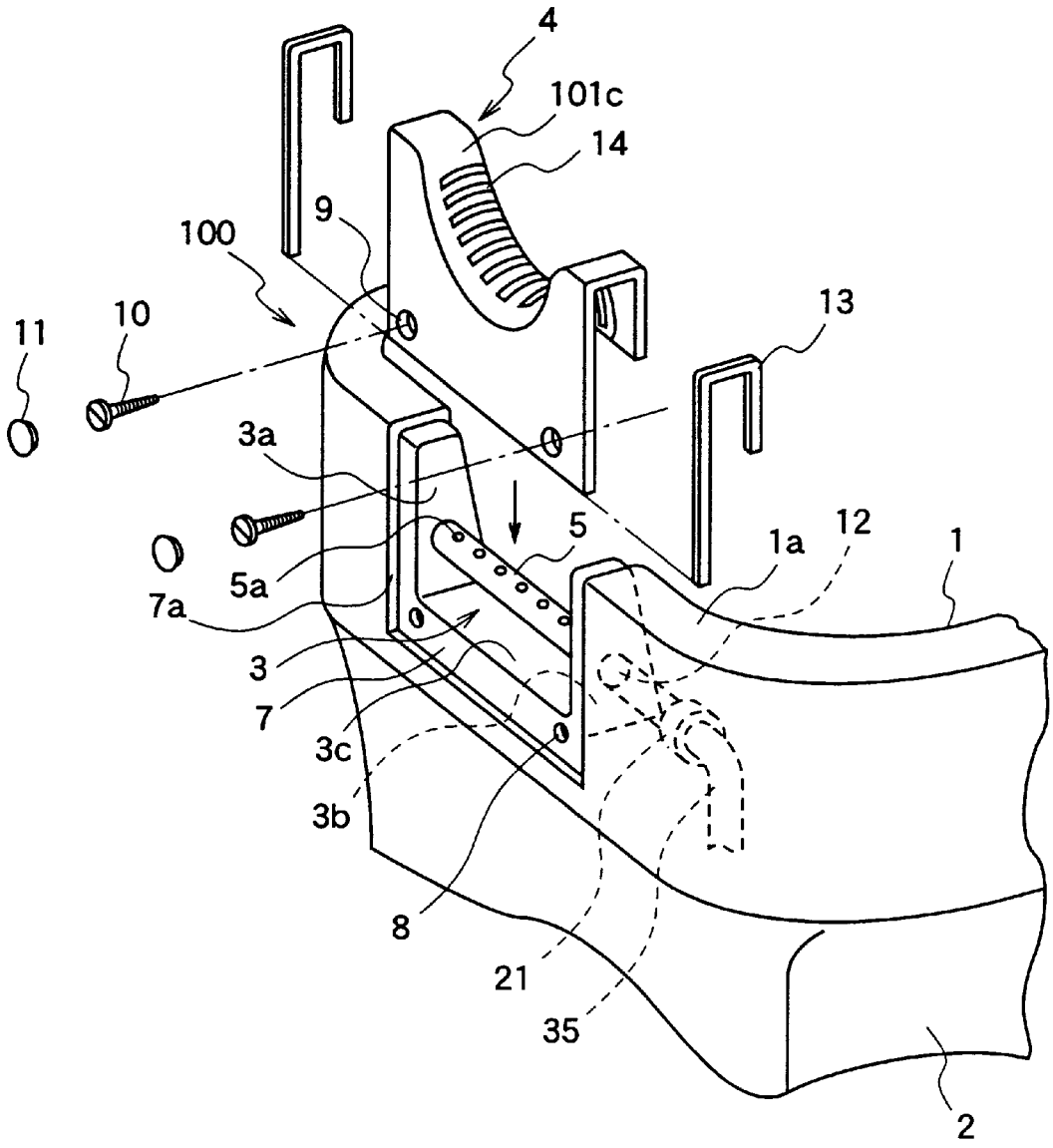
FIG. 2 is a perspective view illustrating a detailed construction of a part having a neck receiving part at an entering edge part of a cistern in the hair washer shown in FIG. 1.

FIG. 2 is a perspective view illustrating a detailed construction of the neck receiving part of the hair washer shown in FIG. 1. FIG. 3 illustrates a construction of the neck receiving member shown in FIG. 1. FIGS. 3(*a*), 3(*b*), 3(*c*), 3(*d*), and 3(*e*) are a perspective view, a front view, a rear view, a plan view of the neck receiving part of the hair washer, and a side view, respectively.

In these figures, a notch 3 having left and right sides 3*a* and 3*b* which are vertical to the extending direction (longitudinal direction) of the entering edge part 1*a* and a horizontal bottom 3*c*, are formed at the entering edge part 1*a* of the cistern 1. Then, a stepped portion 7 is formed along the notch 3 and tapped holes 8 are bored at a part of the stepped portion 7 along the bottom 3*c* of the notch 3.

A pipe through hole 12 is bored at each of lower opposed positions on the left and right sides 3*a* and 3*b* of the notch 3 and a washing pipe 5 is provided so as to pass through the pipe through holes 12. The washing pipe 5 has numerous spray holes 5*a* arranged in the axial direction on a part of its peripheral surface, which faces upwardly. A tip of the washing pipe 5 is closed and a rear end thereof is connected to a water supply pipe 35 by a coupler 21.

The neck receiving member 4 comprises a board, which is bent in the form of an approximately inverted J, is formed such that a peripheral part thereof, except for a lower edge part of its rear surface, overlaps with a peripheral part of the notch at the entering edge part of the cistern 1, and has the neck receiving part 101*c* on a part of its upper surface part except for left and right edge parts. Here, the neck receiving member 4 comprises an upper surface part 101 comprising left and right edge parts 101*a* and 101*b*, each having an approximately rectangular shape which extends horizontally, and a neck receiving part 101*c* which extends between the left and right edge parts 101*a* and 101*b* such that a front end thereof is aligned with front ends of the left and right edge parts 101*a* and 101*b*, a rear end thereof projects in the form of a semicircle from rear ends of the left and right edge parts 101*a* and 101*b*, curves in the form of a recess in the longitudinal direction and curves in the form of a convex in the cross direction, a front surface part 102 extending approximately downwardly from a front end of the upper surface part 101, and a rear surface part 103 extending approximately downwardl, from a rear end of the upper surface part 101. Further, numerous slits 14 extending in the cross direction are formed so as to be closely arranged in the longitudinal direction on a rear half part of the neck receiving part 101*c* of the upper surface part 101. Screw through holes 9 are bored on a lower end part of the front surface part 102 at positions which correspond to those of the tapped holes 8 on the stepped portion 7 of the cistern 1.

The neck receiving member 4 is constituted by a two-layer board which is obtained by forming a cushion layer comprising a cushioning material such as styrene foam on a base layer comprising hard resin such as FRP (fiber reinforced plastics).

The neck receiving member 4 is engaged with the stepped portion 7 of the notch 3, leak-prevention packings 13 being intervened between left and right sides 7*a* of the stepped portion 7 and left and right sides of the neck receiving member 4 respectively, and the neck receiving member 4 is attached to the cistern 1 by screwing locking screws 10 through the screw through hole 9 to the tapped holes 8 of the cistern 1. Further, a waterproof cap 11 is put into the screw through hole 9 after the locking screw 10 is screwed.

Operation of the hair washer constituted as above will be described with reference to FIGS. 1 to 3.

Figure 3:
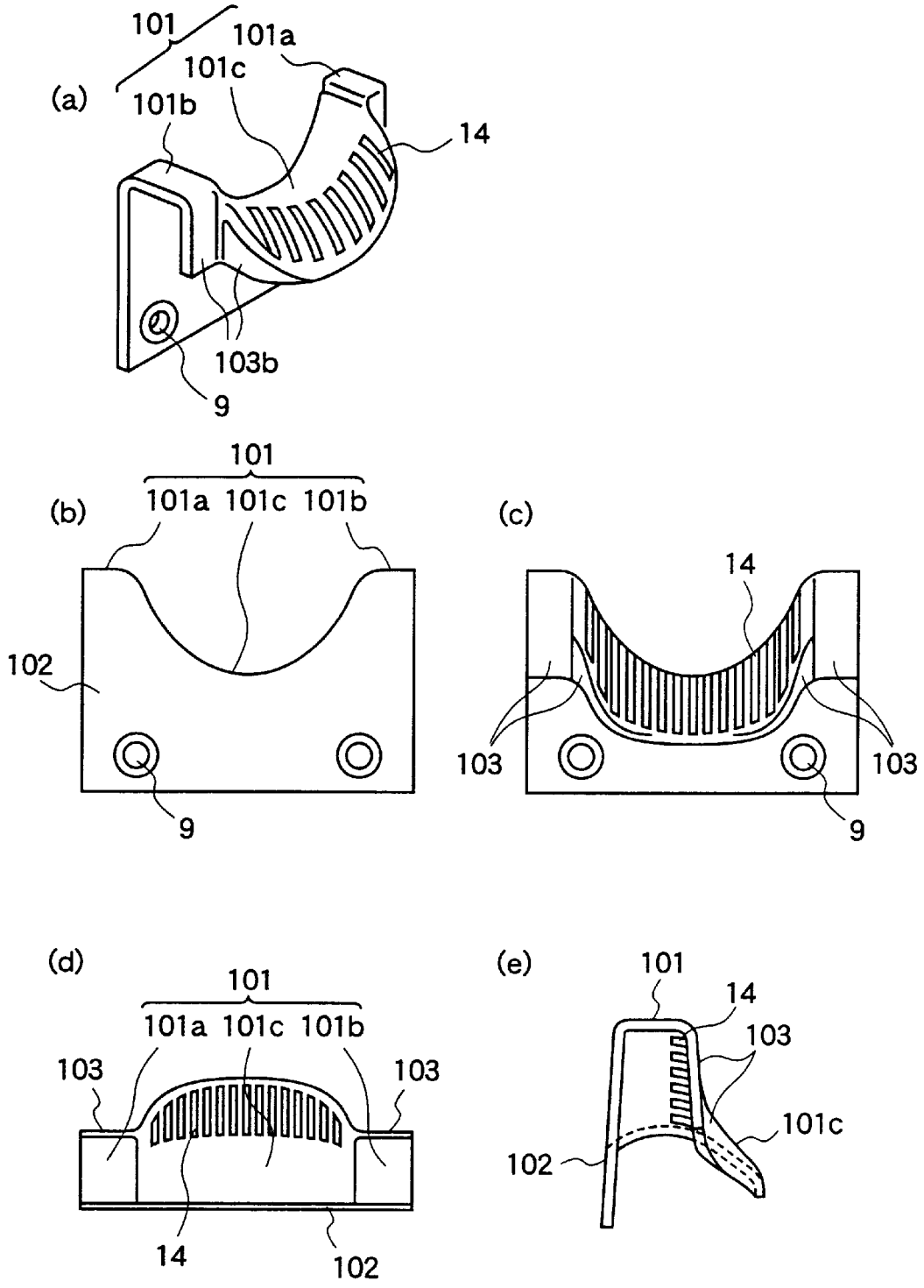
FIGS. 3(*a*), 3(*b*), 3(*c*), 3(*d*), and 3(*e*) are a perspective view, a front view, a rear view, a plan view, and a side view, respectively, which illustrate a construction of a neck receiving member shown in FIG. 1.

In FIGS. 1 to 3, the person 6 under hair washing lies on his back and inserts his head into the opening of the cistern 1, with his neck part being received by the neck receiving part 101*c* of the neck receiving member 4.

When the hair washer is started, the hair is washed at the head part by the shower heads S1 to S7 and nozzle heads N1 to N3. At the same time the wash water is spouted from the washing pipe 5 toward the underside of the neck receiving part 101*c* of the neck receiving member 4 and the spouted wash water reaches to the neck part of the person 6 through the slits 14, thereby washing hair at the neck part of the person 6. In this case, the person 6 is held at the neck part by the neck receiving part 101*c* of the neck receiving member 4, which has the numerous slits 14 formed closely. Therefore, the person 6 feels less as if something is wrong at the neck part relative to the prior art. In addition, the washing pipe 5 is arranged at the notch 3, thereby enabling sufficient spouting of wash water and enhancing the detergency.

(Embodiment 2)

Figure 4:
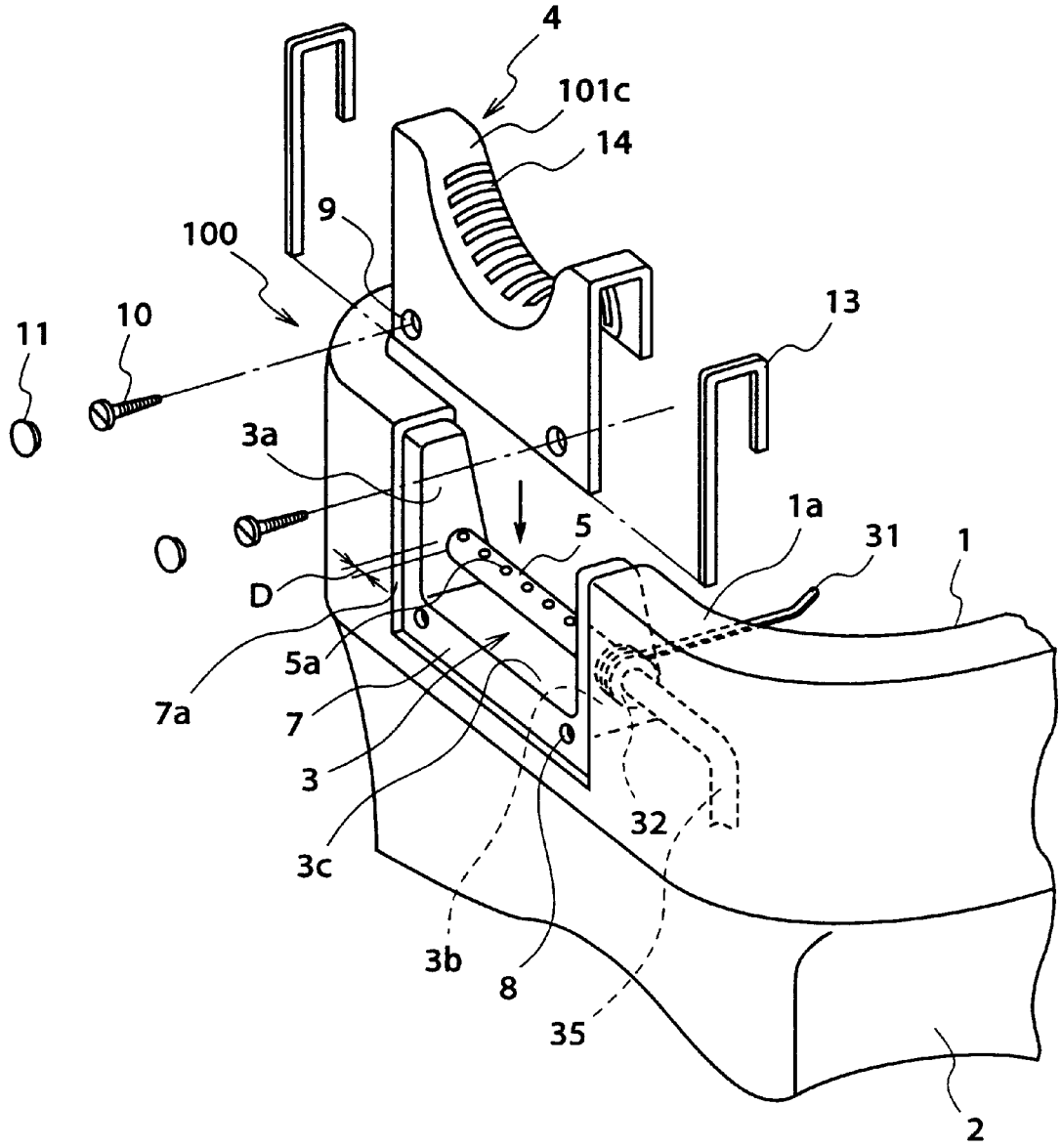
FIG. 4 is a perspective view illustrating a detailed construction of a part having a neck receiving part at an entering edge of a cistern in a hair washer according to a second embodiment of the present invention.

FIG. 4 is a perspective view illustrating a construction of a part having a neck receiving part at an entering edge part of a cistern in a hair washer according to a second embodiment of the present invention.

The hair washer according to a second embodiment can adjust an angle of the wash water spouted from the washing pipe 5.

In the figure, the same reference numerals as those in FIG. 2 designate the same or corresponding parts. The hair washer according to the second embodiment has a coupler 32 disposed on the right side 3*b* of the notch 3, a water supply pipe 35 connected to one end of the coupler 32, and a washing pipe 5 which is rotatably attached to the other end of the coupler 32 so as to have a space D between a tip of the washing pipe 5 and a left side 3*a* of the notch 3. In addition, a lever 31 is arranged at a base end part of the washing pipe 5.

Next, the connection constructed between the washing pipe 5 and the coupler 32 will be described with reference to FIG. 5.

Figure 5:
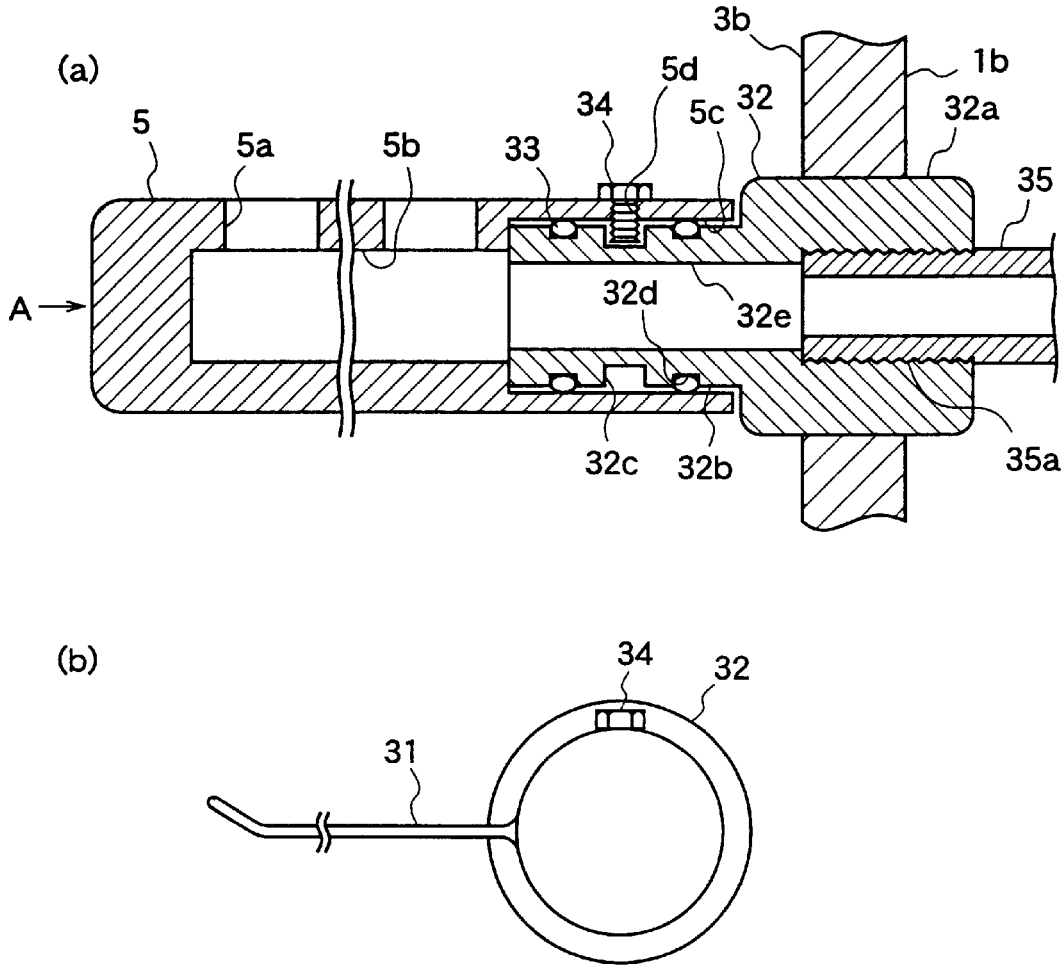
FIG. 5(*a*) is a longitudinal sectional view illustrating a connection construction between a washing pipe and a coupler shown in FIG. 4.

FIG. 5 illustrates the connection constructed between the washing pipe 5 and the coupler 32 shown in FIG. 4. FIG. 5(*a*) is a longitudinal sectional view, and FIG. 5(*b*) is a view seen, from a direction shown by arrow A of FIG. 5(*a*).

In the FIG., the coupler 32 has a cylindrical shape with a step, which comprises a base part 32*a* and an inserting part 32*b* which has a diameter smaller than that of the base part 32*a* and has a guide groove 32*c* and two O-ring grooves 32*d* on its outer circumference surface. A female screw part 32*f* having a diameter larger than that of an inner hole 32*e* of the coupler 32 is formed on an inner circumference of a rear end part of the coupler 32. The base part 32*a* of the coupler 32 is fixed to a sidewall 1*b* of the notch 3 of the cistern 1 so as to penetrate the sidewall 1*b*. The water supply pipe 35 is connected to the female screw part 32*f* of the coupler 32 by being engaged with a male screw part 35*a* which is formed on an outer circumference at its tip part.

The washing pipe 5 has a circular sectional view, and comprises a coupler receiving part 5*c* having a diameter which is larger than that of its inner hole 5*b* and engages with the inserting part 32*b* of the coupler 32 and a length which is approximately equal to that of the inserting part 32*b*, on an inner circumference of its rear end part, and a tapped hole 5*d* bored at a position on the coupler receiving part 5*c*, which corresponds to that of the guide groove 32*c* on the inserting part 32*b* of the coupler 32. The coupler receiving part 5*c* of the washing pipe 5 is engaged with the inserting part 32*b* of the coupler 32, then an O-ring 33 is disposed in the O-ring groove 32*d* on the inserting part 32*b* of the coupler 32, and a guide screw 34 is set to the tapped hole 5*d* of the washing pipe 5. Therefore, by moving the lever 31 upwardly or downwardly, the washing pipe 5 rotates accordingly in a circumferential direction, whereby the spouting angle of the wash water spouted from the spouting holes 5*a* varies.

Next, a method of washing hair at a neck part of a person by the hair washer constituted as above will be described.

First, the hair washer is operated so as to wash hair at a neck part of a person similarly to the first embodiment.

Then, when the wash water is spouted to the neck part of the person from the washing pipe 5, the spouting angle of the wash water spouted from the washing pipe 5 is adjusted by moving the lever 3 upwardly or downwardly.

Therefore, it is possible to wash hair at the neck part in a most suitable condition according to figures, hairstyles, or dirt levels of the hair of the persons.

Figure 6:
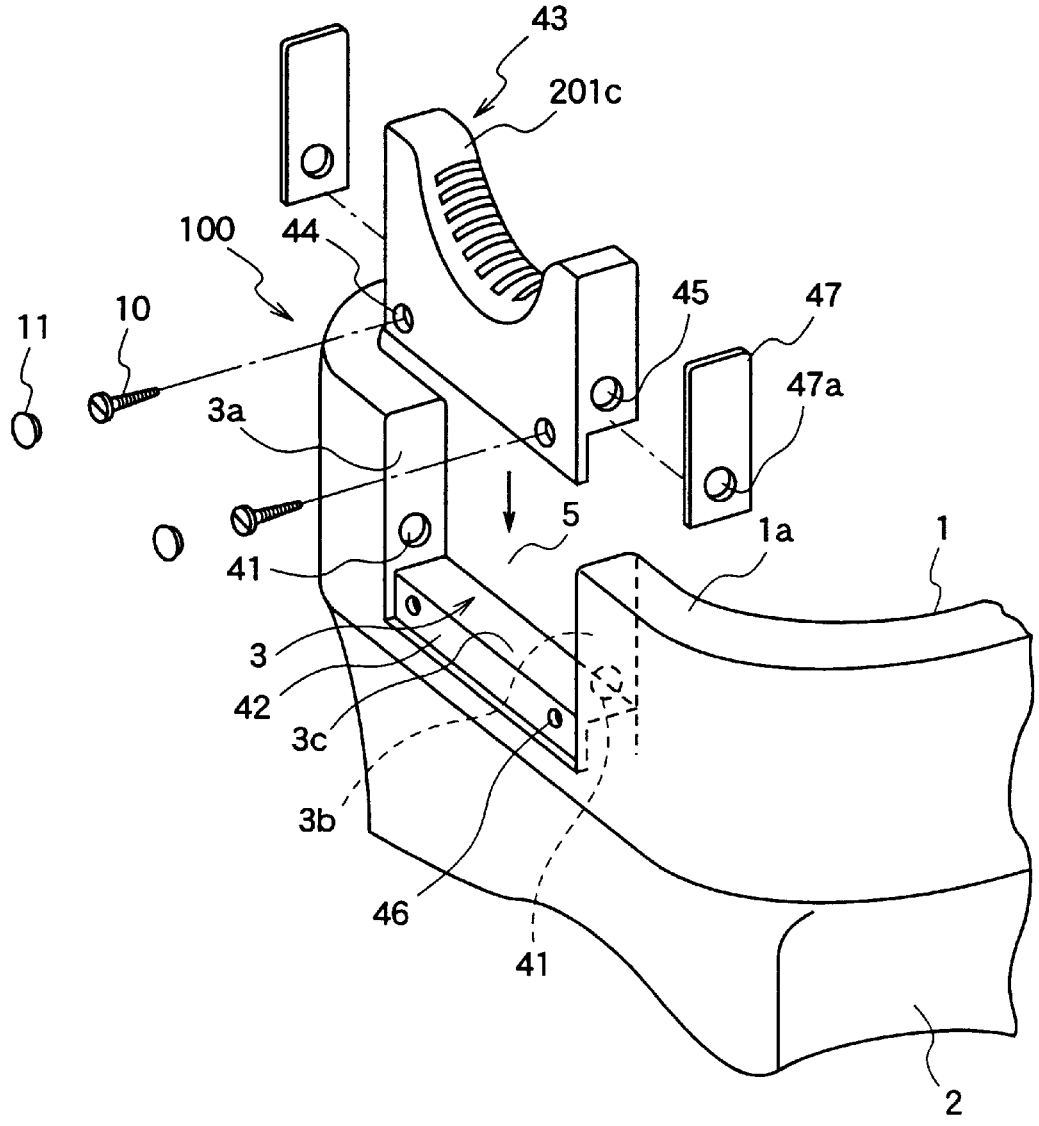
FIG. 6 is a perspective view illustrating a detailed construction of a part having a neck receiving part at an entering edge part of a cistern in a hair washer according to a third embodiment of the present invention.
Figure 7:
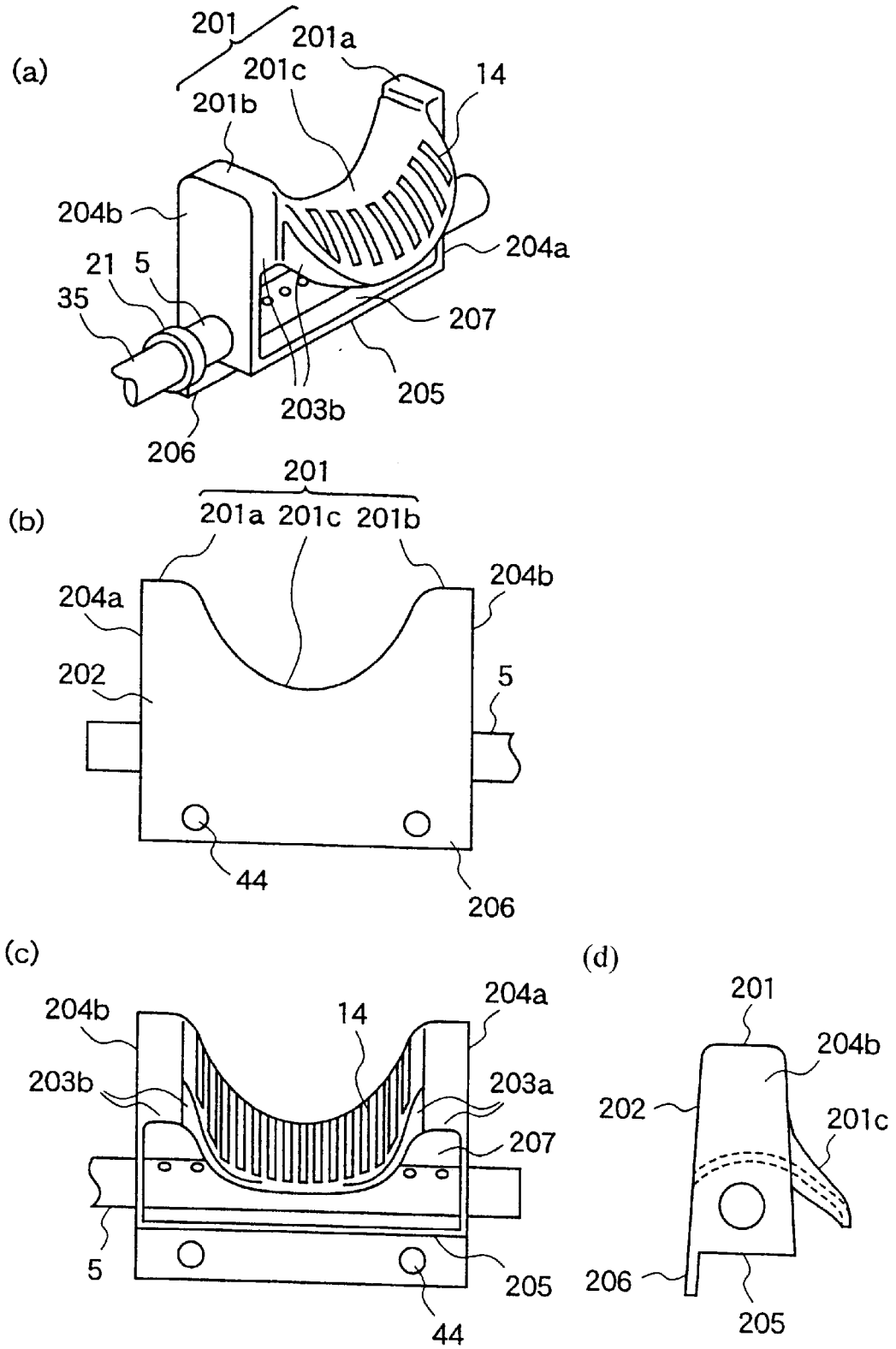
FIGS. 7(*a*), 7(*b*), 7(*c*), and 7(*d*) are a perspective view, a front view, a rear view, and a side view, respectively, which illustrate a construction of a neck receiving member according to the third embodiment.

FIG. 6 is a perspective view illustrating construction of a part having a neck receiving part at an entering edge part of a cistern in a hair washer according to a third embodiment of the present invention. FIG. 7 illustrates a construction of a neck receiving member according to the third embodiment. FIG. 7(*a*) is a perspective view, FIG. 7(*b*) is a front view, FIG. 7(*c*) is a rear view, and FIG. 7(*d*) is a side view.

The hair washer according to the third embodiment is comprised of a neck receiving member 43 including a box body having a neck receiving part 201*c* on its upper wall part, the neck receiving member 43 being attached to an entering edge part 1*a* of a cistern 1 by being engaged with a notch 3 formed at the entering edge part 1*a* of the cistern 1.

In these figures, the same references as those in FIG. 2 designate the same or corresponding parts. The hair washer according to the third embodiment comprises, for example, a notch 3 having left and right sides 3*a* and 3*b* which are vertical to the extending direction of the entering edge part 1*a*, a horizontal bottom 3*c*, and body side pipe through holes 41 at opposed positions on a lower part of the left and right sides 3*a* and 3*b*, formed at the entering edge part 1*a* of the cistern 1, a stepped portion 42 formed along the bottom 3*c* of the notch 3, and tapped holes 46 bored on the stepped portion 42.

The neck receiving member 43 is a box body which is formed to engage with the notch 3. Here, the neck receiving member 43 comprises a bottom wall part 205 which has a shape corresponding to the bottom 3*c* of the notch 3 (rectangular shape in this case) as its lower surface (bottom), left and right side wall parts 204*a* and 204*b* which have shapes corresponding to the left and right sides 3*a* and 3*b* of the notch 3 respectively (approximately rectangular shapes in this case) and have neck receiving side pipe through holes 45 formed at positions on respective lower parts, which correspond to those of the body side pipe through holes 41 on the notch 3, as its outer surfaces (sides), the left and right side wall parts 204*a* and 204*b* extending upwardly from left and right ends of the bottom wall part 205, an upper wall part 201 comprising left and right edge parts 201*a* and 201*b* which horizontally extend from respective upper ends of the left and right side wall parts 204*a* and 204*b* and a neck receiving part 201*c* which has a front end being aligned with the front ends of the left and right edge parts 201*a* and 201*b* and a rear end projecting in the form of semicircle from rear ends of the left and right edge parts 201*a* and 201*b*, and curves in the form of a recess in the longitudinal direction and curves in the form of a convex in the cross direction, between the left and right edge parts 201*a* and 201*b,* a front wall part 202 having respective front ends of the upper wall part 201, the left and right side wall parts 204*a* and 204*b,* and the bottom wall part 205 as its peripheral edges, a rear wall part 203 which has left and right ends respectively connected to the left and right side wall parts 204*a* and 204*b* and extends approximately downwardly from the rear end of the upper wall part 201 such that an opening 207 is formed between a lower end of the rear wall part 203 and the bottom wall part 205, and a mounting part 206 which extends downwardly from a lower end of the front wall part 202 and has screw through holes 44 formed on positions corresponding to those of the tapped holes 46 on the stepped portion 42 of the cistern 1. Further, numerous slits 14 extending in the cross direction are formed so as to be arranged closely in the longitudinal direction on a rear half part of the neck receiving part 201*c* of the upper wall part 201.

Next, a method of attaching the neck receiving member 43 and the washing pipe 5 is described.

To attach the neck receiving member 43, first, the neck receiving member 43 is engaged with the notch 3 and the stepped portion 42 such that the body part of the neck receiving member 43 is positioned on the notch 3 and the mounting part 206 is positioned on the stepped portion 42, and leak-prevention packings 47 are intervened between the left and right sides 3*a* and 3*b* of the notch 3 and the left and right sides 204*a* and 204*b* of the neck receiving member 43, respectively.

Then, a hand is inserted from a door (not shown) of a cabinet 2 inside the entering edge part la of the cistern 1, the washing pipe 5 is passed through the body side pipe through holes 41 of the notch 3, the pipe through holes 47*a* of the packings 47, and the neck receiving side pipe through holes 45 of the neck receiving member 43, and the rear end of the washing pipe 5 is connected to the water supply pipe 35 by using the coupler 21.

Next, the locking screws 10 are screwed in the tapped holes 46 on the stepped portion 42 of the cistern 1 through the screw through holes 44 on the mounting part 206 of the neck receiving member 43, thereby attaching the neck receiving member 43 to the cistern 1. Thereafter, waterproof caps 11 are put into the screw through holes 44 after the locking screws 10 are screwed. In this way, the attaching of the neck receiving member 43 and the washing pipe 5 is finished.

As described above, according to the third embodiment, the neck receiving member 43 which comprises the box body having the neck receiving part 101*c* on the upper wall part is attached to the entering edge part 1*a* of the cistern 1 by inserting the same into the notch 3 which is formed at the entering edge part la of the cistern 1. Therefore, it is possible to attach or detach the neck receiving member 43 easily.

While the neck receiving member 4 and the entering edge part 1*a* of the cistern 1 are independently constituted in the first and second embodiments, they may be integrated.

In addition, while the numerous slits are formed on the upper surface of the neck receiving members 4 or 43 in the first to third embodiments, small holes may be formed in place of the slits.

Further, while the slits are formed at the rear half part of the upper surface of the neck receiving members 4 or 43 in the first to third embodiments, they may be formed on other parts.

While the washing pipe 5 is arranged at the notch 3 in the first and second embodiments, this may be arranged on other parts in the cistern 1, which allow the wash water to spout toward the underside of the neck receiving part 101*c* of the neck receiving member 4.

What is claimed is:

1. A hair washing apparatus comprising a cistern having an opening on an upper part thereof, into which a person under hair washing inserts his head while lying on his back, and a neck receiving part for receiving a neck of the person, a notch formed at an entering edge part of the cistern, said neck receiving part is disposed on top of said notch, wherein the neck receiving part comprises a board having a plurality of slits or small holes;

said cistern comprises a wash water spouting means for spouting wash water toward an underside part of the neck receiving part, said wash water spouting means disposed in said notch; and the wash water spouting means includes a rotatable water supply pipe having a plurality of spouts and a lever provided on the water supply pipe, wherein said lever allows for rotation of the water supply pipe, about the longitudinal axis thereof, to adjust a spouting angle of the wash water.

2. The hair washing apparatus defined in claim 1 comprising a notch formed at the entering edge part of the cistern and a neck receiving member comprising a board which is bent in the form of an approximately inverted J and has said neck receiving part formed on a part except for left and right edge parts on its upper surface part, the neck receiving member being arranged at the notch such that a peripheral part except for a lower edge part of its rear surface overlaps with a peripheral part of the notch at the entering edge part of the cistern.

3. The hair washing apparatus defined in claim 2 comprising the wash water spouting means arranged on a part of the notch, which is covered by the neck receiving member.

* * * * *